US005774893A

United States Patent [19]

Torres

[11] Patent Number: 5,774,893

[45] Date of Patent: Jul. 7, 1998

[54] SIMULATED NECKTIE KNOT AND NECKTIE COMBINATION

[76] Inventor: Miguel Grajales Torres, 7264 Rosanna St., Gilroy, Calif. 95020

[21] Appl. No.: 346,551

[22] Filed: Oct. 26, 1994

[51] Int. Cl.[6] ..... A41D 25/02

[52] U.S. Cl. ..... 2/148; 2/149; 2/150; 2/152.1; 2/153

[58] Field of Search ..... 2/144, 145, 148, 2/149, 150, 152.1, 153, 154, 155, 156, 157, 52; 24/66.3, 66.11

[56] References Cited

U.S. PATENT DOCUMENTS

| | | | |
|---|---|---|---|
| 1,513,998 | 11/1924 | Kapfer | 2/150 |
| 2,040,297 | 5/1936 | Costantini | 2/150 |
| 2,244,692 | 6/1941 | Hall | 2/150 |
| 2,523,130 | 9/1950 | Manfred | 2/144 |
| 2,631,292 | 3/1953 | Cunningham | 2/153 |
| 2,692,387 | 10/1954 | Spaniol | 2/144 |
| 2,714,719 | 8/1955 | Peake | 2/153 |
| 3,506,978 | 4/1970 | Santona | 2/150 |
| 3,745,614 | 7/1973 | Tsang | 2/148 |
| 4,318,189 | 3/1982 | Intengan | 2/144 |
| 4,573,219 | 3/1986 | Hooten | 2/153 |
| 4,627,113 | 12/1986 | Lord | 2/144 |
| 5,010,593 | 4/1991 | Stevens, Jr. | 2/153 |
| 5,218,722 | 6/1993 | Vandenberg | 2/152.1 |
| 5,400,439 | 3/1995 | Petroff | 2/150 X |
| 5,416,925 | 5/1995 | Davis | 2/144 |
| 5,493,731 | 2/1996 | Amnott | 2/148 |
| 5,528,181 | 6/1996 | Camillo | 2/150 |

FOREIGN PATENT DOCUMENTS

| | | | |
|---|---|---|---|
| 552369 | 11/1956 | Belgium | 2/150 |
| 629440 | 11/1927 | France | 2/150 |
| 1218237 | 5/1960 | France | 2/144 |
| 2638949 | 5/1990 | France | 2/144 |
| 2189980 | 11/1987 | United Kingdom | 2/144 |
| 0000894 | 11/1979 | WIPO | 2/144 |
| 4028748 | 12/1994 | WIPO | 2/144 |

*Primary Examiner*—Jeanette E. Chapman
*Attorney, Agent, or Firm*—Donald R. Boys

[57] ABSTRACT

A necktie assembly incorporates a simulated necktie knot and a neckband that allows a fabric necktie tail portion to be added without making a conventional knot. The neckband may be elastic and may be opened, closed, and adjusted in a number of ways. The simulated knot is made in a fashion that leaves a hollow pocket useful for carrying and concealing small articles of many sorts, among these objects a small microphone which may be connected to a transmitter. The body of the simulated knot also serves as a display area for indicia of many sorts, such as emblems, advertising, and the like.

16 Claims, 14 Drawing Sheets

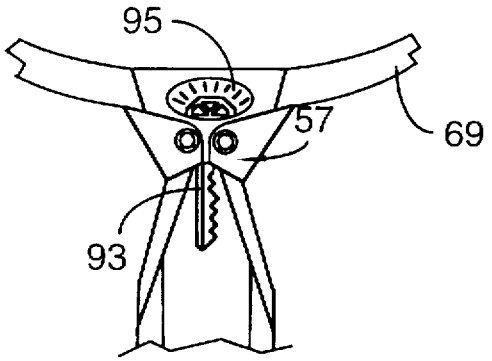
Fig. 24-A
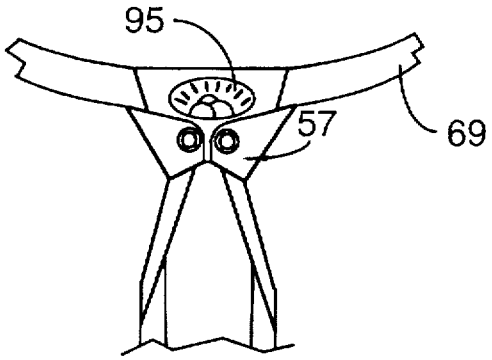
Fig. 24-B
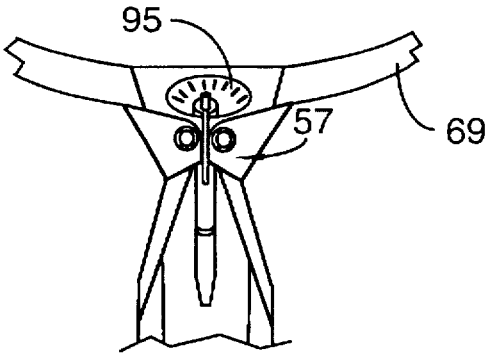
Fig. 24-C

SIMULATED NECKTIE KNOT AND NECKTIE COMBINATION

BACKGROUND OF THE INVENTION

1. Field of the Invention

The present invention is in the field of neckware, and pertains in particular to a necktie having a simulated knot, an adjustable tail length, and an adjustable neckband.

2. Description of the Prior Art

Conventional fabric neckties have been worn by men, and to a lesser extent by women for many decades. A number of U.S. patents have been issued to inventors for neckties of various shapes and sizes, typically made of fabric.

A conventional necktie is tied in a manner that a portion of the necktie fabric passes around a wearer's neck, typically under a shirt collar, providing a neckband, which passes through a knot in the front to provide the tail of the necktie down the front of the wearer's shirt. To make a knot with a neat appearance requires time, considerable expertise, and dexterity, and may be troublesome to many people. For example, to people with arthritis and other disabilities, people with no expertise in tying a necktie knot, and to occasional users. Often, to achieve the desired effect, a user must tie the knot several times. This can be a problem with conventional ties because the repeated tying of the knot soils the portion of the tie used to form the knot and leads to excessive wear and a short useful life.

There have been many simulated necktie knots developed in the art, and there are a number of patents known to the present inventor. Among these are: U.S. Pat. No. 2,530,975, wherein the tail section is not adjustable. Another is U.S. Pat. No. 2,915,757 which teaches a knot cover made of a triangular piece of fabric, which is snapped over the knot of a necktie. Again in this disclosure the tail is not adjustable. Yet another is U.S. Pat. No. 3,030,361 wherein the tail is not adjustable and there is no knot-defining structure. Still another is U.S. Pat. No. 3,146,467 which teaches are three-part device for defining the knot of a necktie. This device is relatively difficult to use and has a relatively short life.

Another prior art patent is U.S. Pat No. 3,369,257, and teaches a pre-tied tailless necktie with collar-engaging wing-type members. U.S. Pat. No. 3,735,420 teaches a neckband with a reversible tie assembly wherein the tail is not adjustable. U.S. Pat. No. 3,955,217 teaches a tail section not adjustable in length and an eyelet connection for a neckband. U.S. Pat. Nos. 4,173,792 and 4,318,189 by the same inventor relate to neckties with simulated knots wherein the knot simulator bodies are covered by shields which are maintained by hooked keepers which may be unsafe.

SUMMARY OF THE INVENTION

In a preferred embodiment of the present invention a necktie is provided comprising a tail portion, a neckband, and a hollow, simulated knot allowing a user to make a realistic-looking necktie without having to tie a conventional knot. The simulated knot can be made in a wide variety of ways, and the neckband can be made elastic or not elastic, and adjustable by a number of devices. The simulated knot can be made from a wide variety of materials, and provides a display area for emblems, logos, advertisement, and many other indicia.

An important object of the present invention is to provide an improved neckware having a minimum number of parts, which is easily installed, and appears neat and stylish. Another important object of the invention is to provide a new, easy, and quick way to make an attractive necktie without the time it typically takes to make a knot. Another object is to provide a compartment within the necktie apparatus for concealing and carrying small objects such as a condom, car keys, a pen, a penlight, and the like. Such a compartment may also be used for a miniature microphone or other electronic device. Yet another object is to provide a unique placement for indicia such as advertisement, publicity, signals and the like.

Neckties according to embodiments of the present invention are easy to use, are very light, are attractive, are soft and comfortable, are safe, are easy to clean, are length adjustable, are easily assembled and disassembled, are durable, and allow existing neckties to be used with a simple alteration (rear tail must be shortened.).

BRIEF DESCRIPTION OF THE DRAWING FIGURES

FIG. 24*a* shows a simulated knot concealing a key according to an embodiment of the present invention.

FIG. 24*b* shows a simulated knot concealing coins according to an embodiment of the present invention FIG. 24*c* shows a simulated knot concealing coins according to an embodiment of the present invention.

Figure 25:
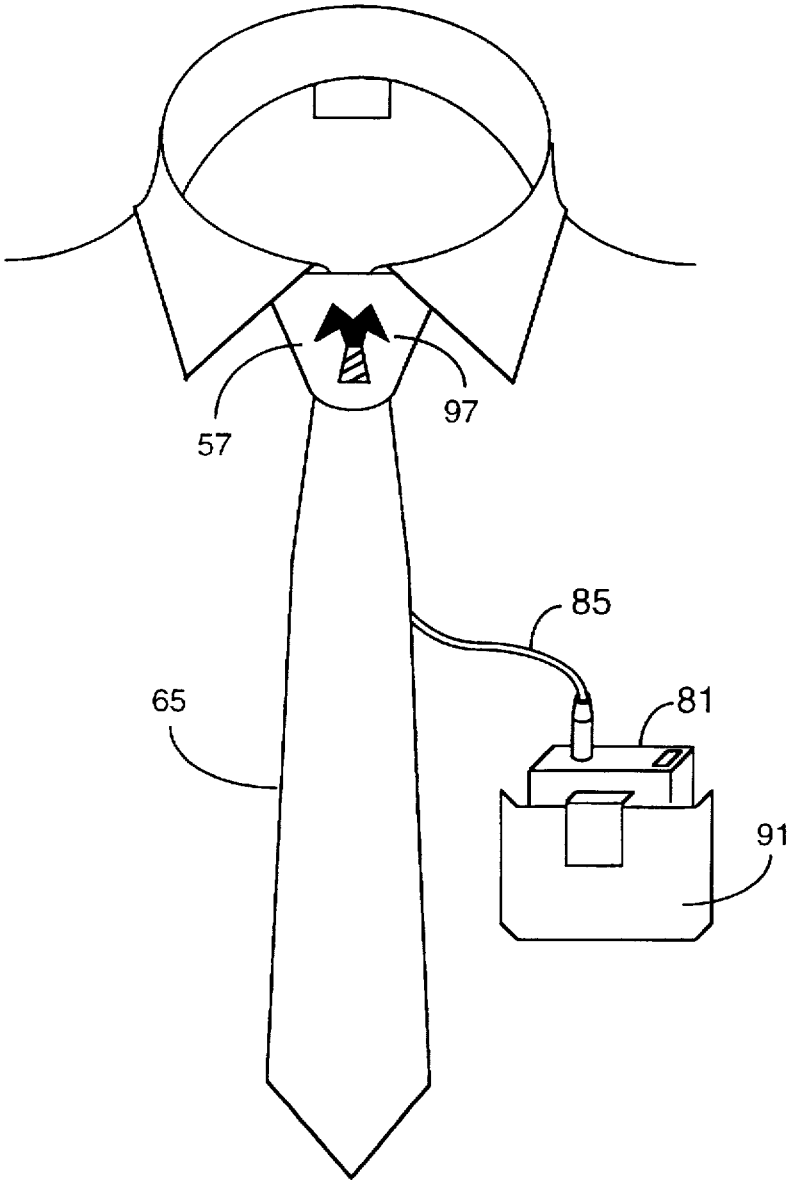

FIG. 25 is a front elevation view of a necktie according to the present invention secured to a user's shirt and collar, and concealing a microphone and having a connecting cable to a recorder.

DESCRIPTION OF THE PREFERRED EMBODIMENTS

Figure 1:
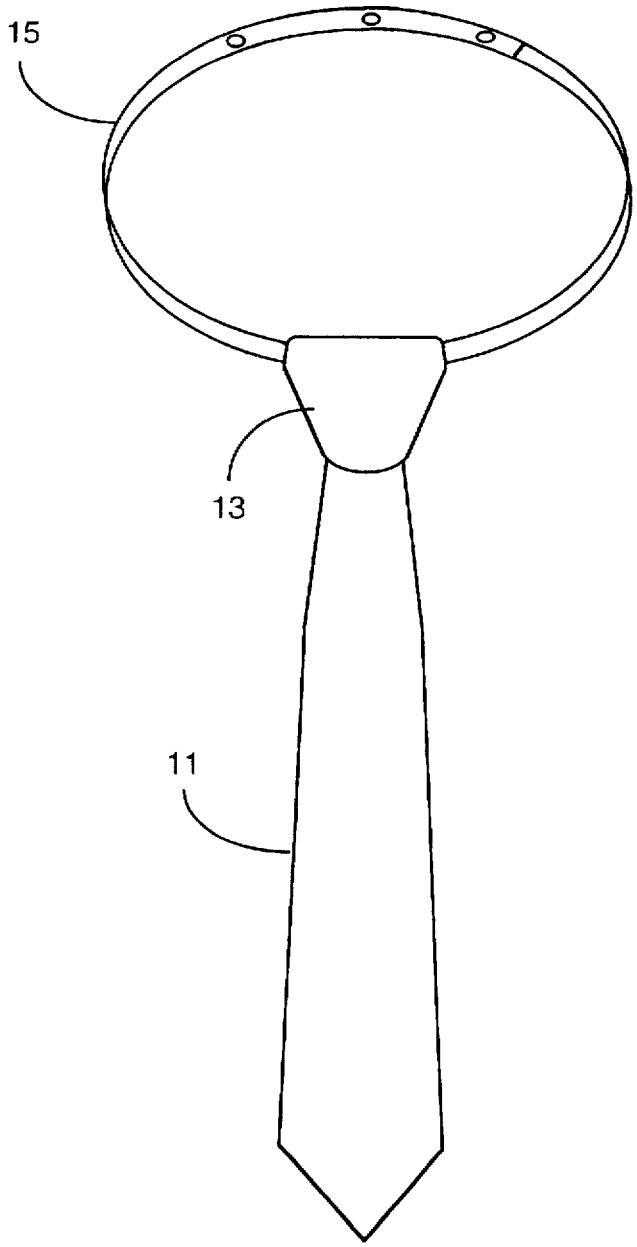
FIG. 1 is an elevation view of an assembled necktie according to an embodiment of the present invention.

FIG. 1 is an elevation view of an assembled necktie according to an embodiment of the present invention, comprising three principle parts; these being a fabric necktie portion 11, a simulated knot portion 13, and a neckband portion 15. The simulated knot is a separate portion from fabric of portion 11, and neckband portion 15 is, in a preferred embodiment, both elastic and adjustable in other ways. Details of all of these portions in several embodiments are further described below with reference to other figures.

Figure 2:
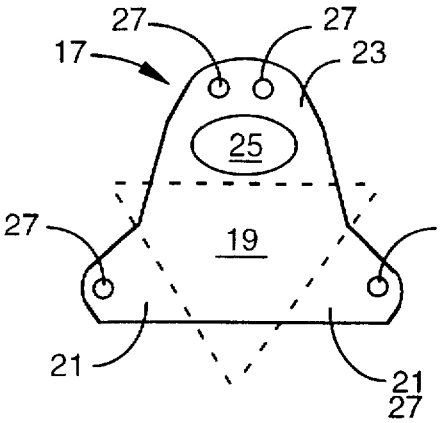
FIG. 2 is a plan view of a blank for forming a simulated knot according to the embodiment of FIG. 1.

FIG. 2 is a plan view of a blank for forming a simulated knot according to the embodiment of FIG. 1. The blank in this form may be made of a wide variety of suitable materials, such as metal, plastic, fabric, paper, leather, and so forth. If metal, it may be a precious metal, such a gold or silver. The needed characteristic is that the material be available in thin sheets for making such a blank, and that the blank, once made to shape, be amenable to further bending and forming as is shown in subsequent figures described below to make the simulated necktie knot.

Blank 17 comprises a body portion 19 having no openings in this embodiment, two symmetrical wing portions 21, to be used for forming an enclosure defining the simulated knot, and an upper portion 23 having an opening 25 which will form an access opening to the simulated knot when fully formed as described below. Each of wing portions 21 has a single hole 27 which will be used for mounting rivets, and upper portion 23 has two such holes which will mate with the similar holes in wing portions 21. Three dotted lines 29 are axis lines about which the material of the blank will be further formed to make a simulated knot.

Figure 3:
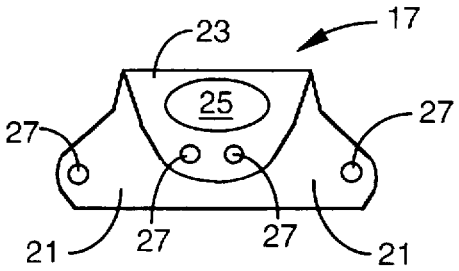
FIG. 3 is a view of the blank of FIG. 2 with a first fold made for forming a simulated knot according to the embodiment of FIG. 1.

FIG. 3 is a view of the blank of FIG. 2 with a first bend made for forming a simulated knot according to the embodiment of FIG. 1. In FIG. 3 upper portion 23 is bent around one of the axis lines 29 (see FIG. 2) .

Figure 4:
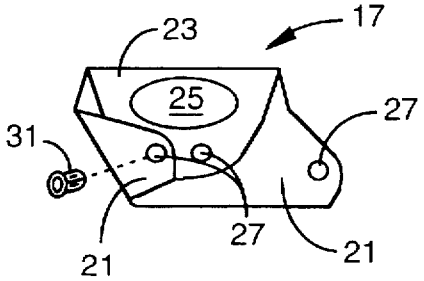
FIG. 4 is a view of the blank of FIG. 3 with a second fold made, and showing placement of a rivet.

FIG. 4 is a view of the blank of FIG. 3 with a second bend made around another of the axis lines 29, bringing one of wing portions 21 into position that holes 27 in the bent wing portion and the bent upper portion align. A rivet 31 is shown in FIG. 4 in position to be passed through aligned holes 27 in the upper portion and the wing portion thus bent.

Figure 5:
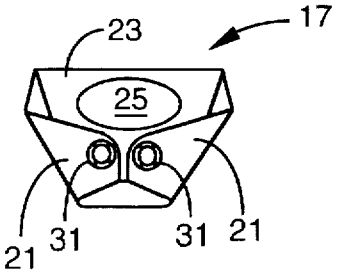
FIG. 5 shows the blank of FIG. 4 with a final fold and rivets in place.

FIG. 5 shows the blank of FIG. 4 with a final bend made with the second wing portion 21 to accomplish the final form of the simulated knot. In FIG. 5 the simulated knot is in its final form with rivets in place. It is seen in FIG. 5 that opening 25 is now presented as an upper opening into the simulated knot, and a new lower opening 33 has been forming by the bending and fastening. As will be seen in further description below, opening 33 is the opening through which a fabric necktie tail will extend in an assembly of a fabric necktie portion and the simulated knot to make a useful necktie.

Figure 6:
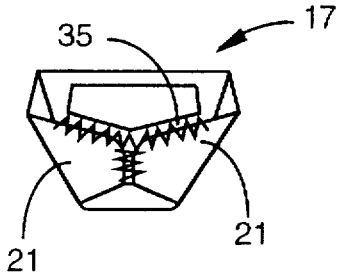
FIG. 6 shows an alternative fastening for a blank to form a simulated knot according to an embodiment of the invention.

FIG. 6 shows an alternative fastening for a blank to form a simulated knot according to an embodiment of the invention. In this embodiment the simulated knot begins as a blank, just as in the embodiment described with reference to FIG. 2 through FIG. 5, but, instead of rivets, the various parts are stitched into position after bending of the blank by stitching 35.

Figure 7:
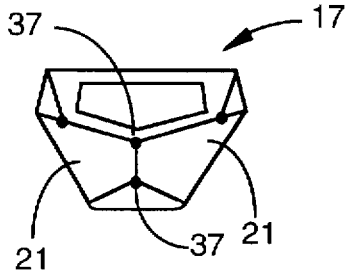
FIG. 7 shows another alternative construction for a simulated knot according to an embodiment of the present invention.

FIG. 7 shows another alternative construction for a simulated knot according to an embodiment of the present invention, wherein the blank is metal and the fastening is by welding points, such as points 37.

Figure 8:
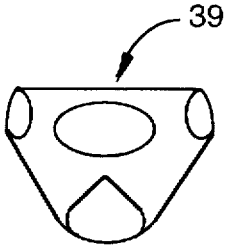
FIG. 8 shows still another alternative construction of a simulated knot according to an embodiment of the present invention.

FIG. 8 shows still another alternative construction of a simulated knot 39 according to an alternative embodiment of the present invention, wherein the simulated knot is formed from material such as carved wood, molded plastic, or blown or molded glass. In this embodiment there is no blank to be folded or bent, and no fasteners are necessary. In this embodiment the material may also be gold, silver, or other precious metal, or precious stone.

Figure 9:
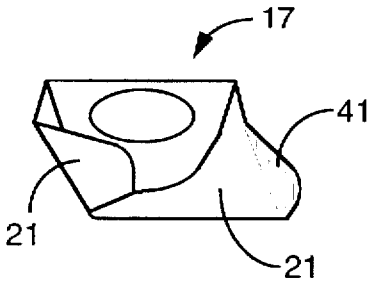
FIG. 9 shows still another alternative construction of a simulated knot according to an embodiment of the present invention.

FIG. 9 shows still another alternative construction of a simulated knot according to an embodiment of the present invention. This embodiment is quite similar to the embodiments presented with reference to FIGS. 2–7, and the fastening is by gluing. A glue area 41 is shown in the figure. It will be apparent to those with skill in the art that, in the blank form for making a simulated knot according to embodiments of the present invention, fastening of the wings to the upper portion may be done in many different ways without departing from the spirit and scope of the invention.

Figure 10:
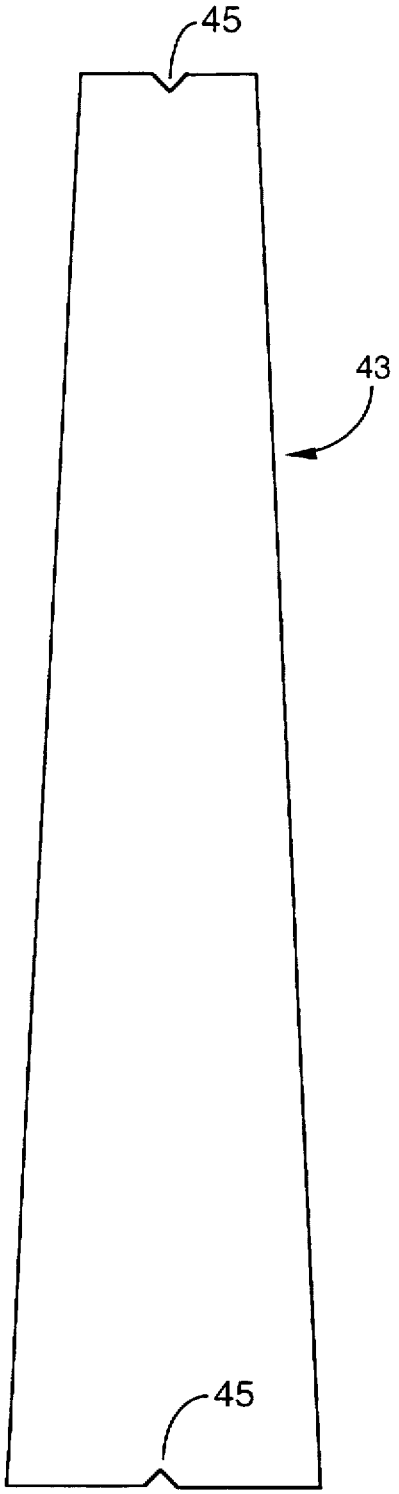
FIG. 10 illustrates a first step in the construction of a necktie as used in an embodiment of the present invention.
Figure 11:
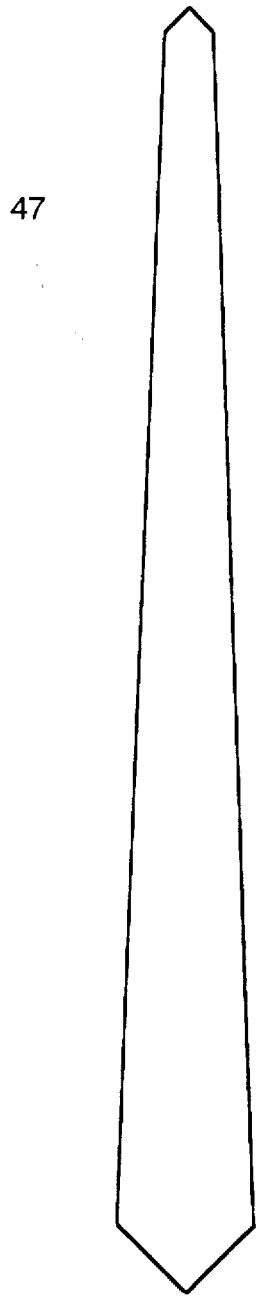
FIG. 11 illustrates a second step in the construction of the necktie of FIG. 10.
Figure 12:
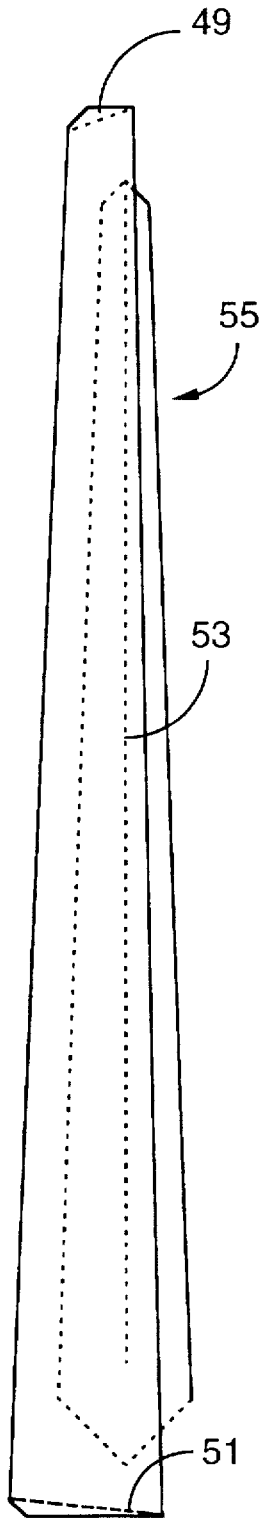
FIG. 12 illustrates a third step in construction of the necktie of FIG. 10.

FIG. 10 illustrates a first step in the construction of a necktie as used in an embodiment of the present invention. A fabric blank 43 is in this embodiment about 35 inches in length, 8 inches in width at the wide end, and 3 inches in width at the narrower end. There is a small notch 45 at about the center of both the wide end and the narrow end as a sewing guide. FIG. 11 illustrates a second step in the construction of the necktie of FIG. 10, a piece of interfacing fabric 47 shaped like a necktie, which will be sewed to be inside the short necktie that will result. FIG. 12 shows the process of sewing blank 43 and interfacing fabric 47 together. Blank 43 is folded lengthwise along a centerline between notches 45, then the two pieces are sewn together along lines 49 at the top, 51 at the bottom, and 53 along one edge, providing a single tie portion 55.

Figure 13:
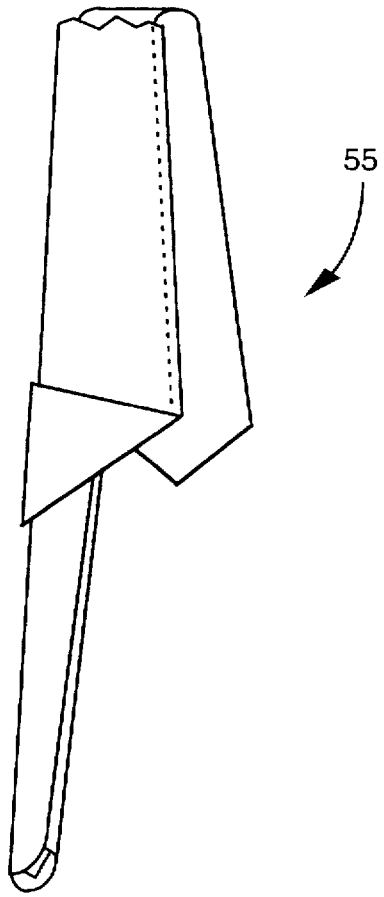
FIG. 13 illustrates a fourth step in the construction of the necktie of FIG. 10.
Figure 14:
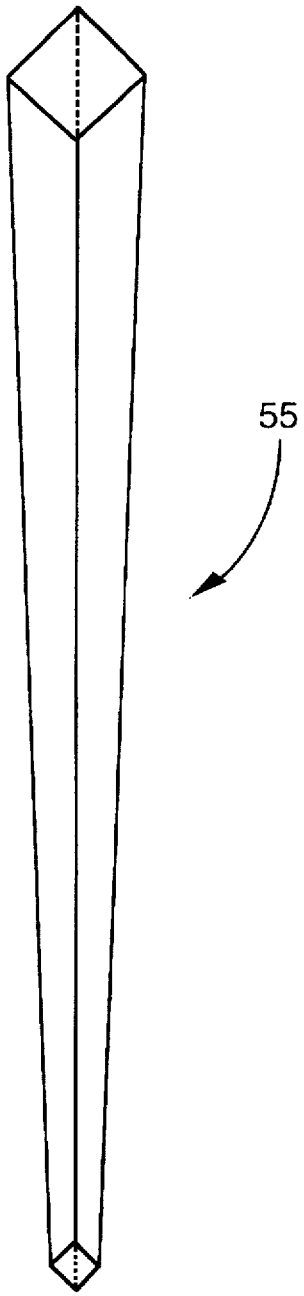
FIG. 14 illustrates a final step in the construction of the necktie of FIG. 10.

In FIG. 13 illustrates a fourth step in the construction of the necktie of Fig. 10. In this illustration the sewn-together assembly 55 shown in FIG. 12 is turned inside-out to produce the final result shown in FIG. 14, which is a short necktie 55 of about 34 inches length, 3½ inches width at the widest portion, and about 1 inch wide at the narrow end. The view of FIG. 14 is from the rear. In this embodiment the tie is of conventional shape at the wider end, but tapers linearly to the narrow end, which is not conventional.

Referring now back to FIG. 1, it was described with the aid of that figure that the necktie assembly of the present invention in its several embodiments comprises three principle portions: a necktie portion 11, a simulated knot portion 13, and a neckband portion 15. These three portions are shown again in FIG. 15, FIG. 16 and FIG. 17 with further detail and in a manner to describe how the three portions relate to one another to create a necktie assembly according to an embodiment of the present invention.

Figure 15:
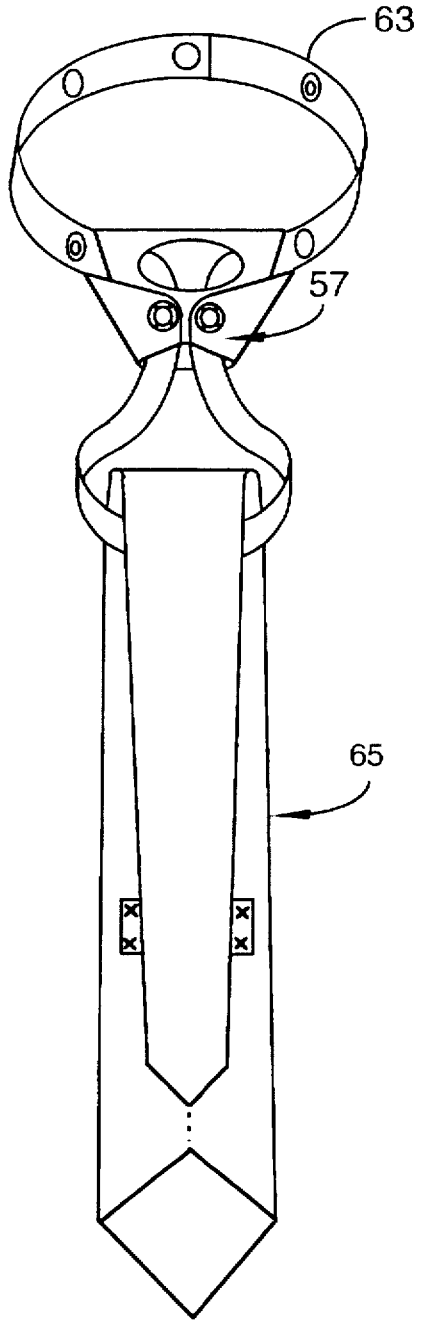
FIG. 15 is a rear elevation view of a first step in assembling a necktie to a neckband and a simulated knot according to an embodiment of the present invention.

FIG. 15 shows a simulated knot 57 of the sort described above with reference to FIGS. 1 through 5. This simulated knot is riveted, and shows upper opening 25 and lower opening 33. There are also, because of the way the blank is bent and fastened, two side openings 59 and 61 to the interior of the simulated knot. An elastic neckband 63 is made of elastic material, therefore stretchable, and has also a number of snap fasteners placed at regular intervals. The snap fasteners make it possible to open the neckband so it can be passed through openings in the simulated knot, and also to adjust the size of the neckband for users with necks of different sizes.

Neckband 63 is first opened (not shown) and passed through side openings 59 and 61 in simulated knot 57, then closed (fastened by a set of the snap, fasteners). Next, a portion of the neckband is extended through bottom opening 33 as shown in FIG. 15. Next, a necktie portion 65 fashioned as described in FIGS. 10–14 is folded over the portion of the neckband that is extended through lower opening 33, and adjusted for length.

Figure 16:
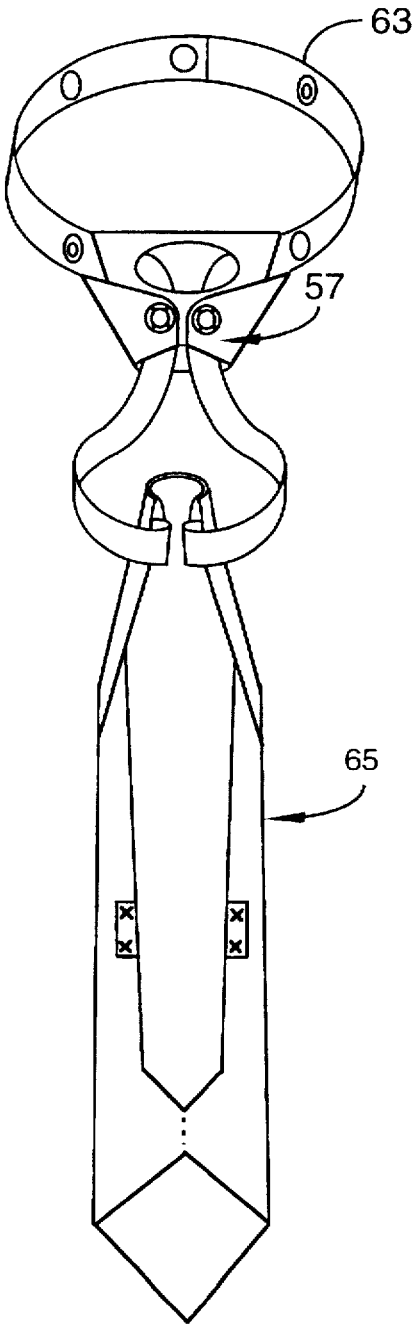
FIG. 16 illustrates a second step in the assembly for the embodiment of FIG. 15.
Figure 17:
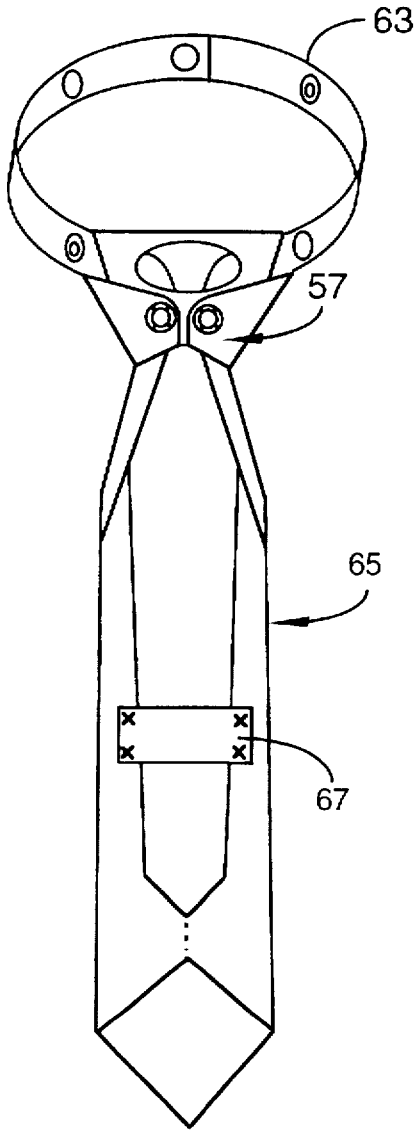
FIG. 17 illustrates a third step in the assembly for the embodiment of FIG. 15.

Consider now FIG. 16. To insert necktie portion 65 into lower opening 33 of simulated knot 57 to provide an appearance of a knotted necktie, the outer edges of necktie portion 65 are rolled toward one another to the rear (the view of FIGS. 15–17 is from the rear) along with the portion of neckband 63 over which the necktie portion 65 is folded. Then neckband 63 is pulled from above to draw the rolled tie portion with the neckband up into lower opening 33.

Once portion 65 is drawn up into the simulated knot, the assembly of the necktie according to this embodiment is complete. The neckband can still be opened and adjusted for overall diameter. To readjust the length of the necktie tail portion, a user can grasp the simulated knot, pull downward withdrawing the neckband and necktie portion from lower opening 33, and then adjust the length of the tail. The above procedure is then followed again. In fabric necktie portion 65 in this embodiment, a tuck strip 67 has been added to have a place to tuck in the narrower portion of the tail as shown in FIG. 17.

Figure 18:
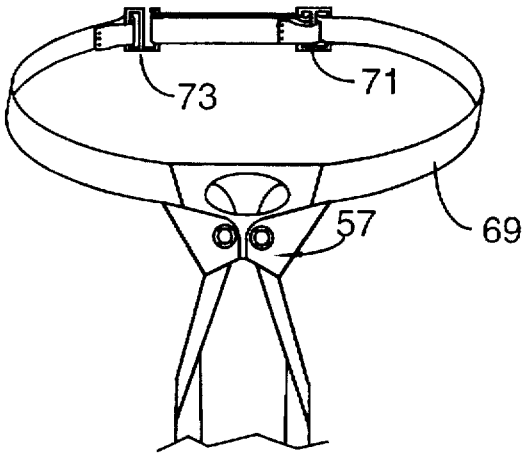
FIG. 18 shows an alternative neckband in an alternative embodiment of the present invention.

FIG. 18 illustrates an alternative neckband 69 for the combination shown in FIGS. 15–17. In this embodiment neckband 69 is non-elastic, and has a slide buckle 71 and a hook 73, such as a bra hook.

Figure 19:
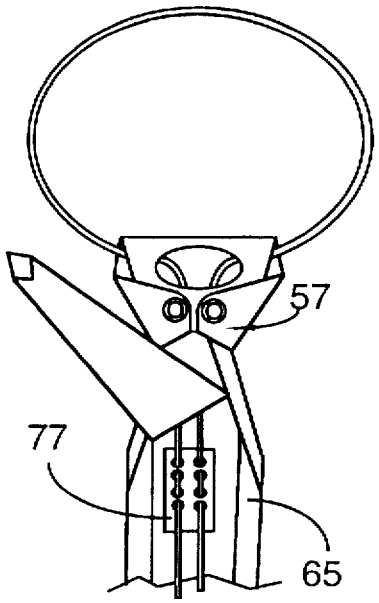
FIG. 19 illustrates yet another alternative neckband in an alternative embodiment of the present invention.

FIG. 19 illustrates yet another alternative for a neckband. In this embodiment a neckband 75 is made of string or cord, and is adjusted by means of a string retainer 77 on the inside of necktie fabric portion 65.

Figure 20:
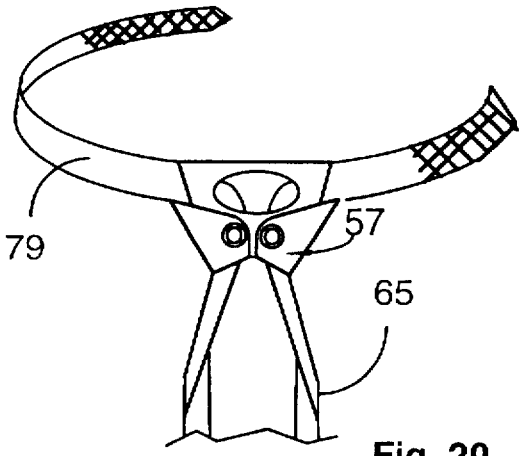
FIG. 20 illustrates still another neckband in an alternative embodiment of the present invention.

FIG. 20 illustrates yet another alternative neckband 79 which is nonelastic and separable and fastenable by areas of velcro.

Figure 21:
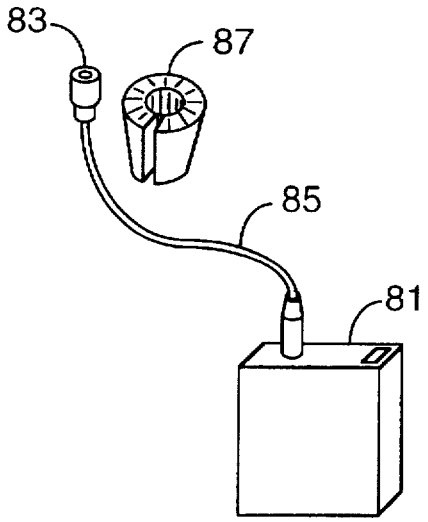
FIG. 21 shows parts for use in concealing a small microphone in a necktie according to an embodiment of the present invention.
Figure 22:
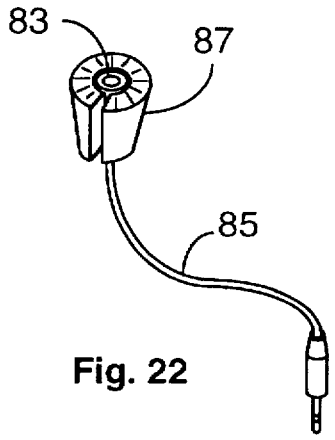
FIG. 22 shows parts from FIG. 21 preassembled.
Figure 23:
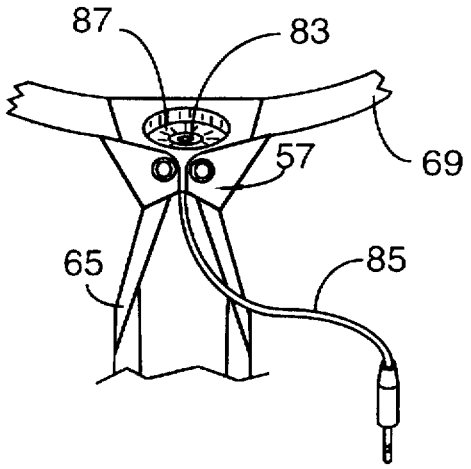
FIG. 23 shows the parts of FIG. 22 concealed in a simulated knot in a necktie assembly according to an embodiment of the present invention.

Referring now back to FIGS. 5–8 and 15–17, an important feature of the simulated knot in embodiments of the present invention may be clearly seen. This is the characteristic of the simulated knot that it is essentially hollow, even in use with a fabric portion drawn up into position. This characteristic may be exploited to provide a unique combination of elements wherein various items may be carried and concealed. FIGS. 21–23 illustrate a combination in an embodiment of the invention wherein the pocket formed in the simulated knot is used for concealing and carrying a microphone.

FIG. 21 shows a wireless transmitter 81, a small microphone 83 connected to the transmitter by a cable 85, and a split rubber plug 87. FIG. 22 shows microphone 83 inserted in an opening in plug 87 with cable 85 extending from the bottom of the plug. FIG. 23 shows the assembly of FIG. 22 inserted into a simulated knot 57 according to an embodiment of the present invention, with cable 85 extending from the bottom of the simulated knot. FIG. 25 shows the same assembly from the front with cable 85 inserted into transmitter 81 and with the transmitter in a pocket 91 of a wearer's shirt.

FIG. 25 also illustrates another important feature of the present invention. The portion of simulated knot 57 presented to the front provides a presentation area for indicia of many sorts. In FIG. 25 indicia 97 is a simple picture, but the area may be used for letters, signs, numbers, logotypes, pictures emblems, combinations of these, and any imaginable visual art. The indicia may be glued, painted printed, silk-screened, or transferred in a variety of other ways. This area may also be used for an article of jewelry. The surface may also be engraved. It may also be plated. In some preferred embodiments the surface of the simulated knot may be decorated in the pattern of the fabric tail portion to more completely simulate a conventional necktie.

FIGS. 24*a* through 24*c* show the pocket formed in a simulated knot according to embodiments of the present invention used for carrying a key 93 (FIG. 24*a*), coins (FIG. 24*b*, and a pen (FIG. 24*c*). In these embodiments a pocket liner 95 similar to plug 87 of FIG. 23 is used.

It will be apparent to those with skill in the art that there are many alterations that may be made in the embodiments disclosed without departing from the spirit and scope of the invention. Many such alternatives have already been described above. There are, for example, a wide variety of materials suitable for the various portions of a necktie assembly according to embodiments of the present invention. There is similarly a broad variation in sizes that may be provided. Indicia on a simulated knot may be nearly any sort of indicia. There are similarly many other alterations that may be made without departing from the spirit and scope of the invention, and the invention may be limited only by the claims below.

What is claimed is:

1. A necktie assembly, comprising:

a simulated knot comprising a three-cornered hollow body having self-supporting walls including a front surface and a rear surface, a first opening at one corner, a second opening substantially equal to the first opening at a second corner, a third opening larger than the first and the second opening, the third opening at a third corner, and a fourth opening larger than the third opening in the rear surface positioned immediately below a line extending between the first and second openings;

a neckband passing into the first opening, through the hollow body, and out the second opening;

a liner component shaped to fit and inserted into the fourth opening of the simulated knot into the interior of the hollow body; and a necktie tail portion passing into the third opening, over the neckband, and out the third opening;

wherein the liner component is adapted to support an article inserted into the liner component to be concealed by the necktie assembly.

2. A necktie assembly as in claim 1 wherein the neckband has a releasable connector for opening to place around a user's neck and an adjuster for adjusting the length of the neckband.

3. A necktie assembly as in claim 2 wherein the neckband is also elastic.

4. A necktie assembly as in claim 1 wherein the self-supporting walls of the simulated knot are formed from a single sheet of self-supporting, flexible material.

5. The necktie assembly of claim 4 wherein the material of the single sheet is plastic.

6. The necktie assembly of claim 4 wherein the material of the single sheet is metal.

7. The necktie assembly of claim 1 wherein the three-cornered hollow body is formed as a single, contiguous structure.

8. The necktie assembly of claim 7 wherein the three-cornered hollow body is fashioned is one of the group of carved wood, molded plastic, blown glass, molded glass and cast metal.

9. The necktie assembly of claim 1 wherein the three-cornered hollow body has a front surface decorated -with one or both of graphic and alphanumeric indicia.

10. The necktie assembly of claim 9 wherein the front face is decorated in three-dimensional relief.

11. The necktie assembly of claim 7 wherein the material of the three-cornered hollow body is fashioned of a material from the group of gemstones and precious metals.

12. The necktie assembly of claim 1 wherein the liner component is adapted to support a microphone of a size to fit within the liner component and be completely concealed by the simulated knot.

13. A necktie assembly as in claim 1 wherein the liner component is adapted to support an article selected from the group of pens, pencils, keys, and coins.

14. The necktie assembly of claim 12 further comprising a microphone supported by the liner component and concealed within the simulated knot, the microphone having a cable extension ending in a connector adapted to engage a plug in a portable wireless transmitter.

15. The necktie assembly of claim 14 including a portable wireless transmitter.

16. A method for forming a necktie assembly, comprising steps of (a) fashioning a simulated knot comprising a three-cornered hollow body having self-supporting walls, a first opening at one corner, a second opening substantially equal to the first opening at a second corner, and a third opening larger than the first and the second opening, the third opening at a third corner;

(b) passing a neckband into the first opening, through the hollow body, and out the second opening;

(c) drawing a loop of the neckband from the interior of the hollow body out through the third opening;

(d) draping a necktie tail component through the loop of the neckband drawn out through the third opening such the necktie tail component forms a front portion and a rear portion; and (e) drawing the necktie tail component into the hollow body by withdrawing the neckband through the third opening, providing thereby a simulated necktie with a knot.

* * * * *